United States Patent [19]

Foxcroft

[11] 4,392,794

[45] Jul. 12, 1983

[54] PERISTALTIC PUMP

[76] Inventor: Arthur Foxcroft, P.O. Box 217, Trenton, Ontario, Canada

[21] Appl. No.: 220,271

[22] Filed: Dec. 29, 1980

[51] Int. Cl.[3] ..... F04B 43/14

[52] U.S. Cl. ..... 417/475; 417/477

[58] Field of Search ..... 417/475, 477

[56] References Cited

U.S. PATENT DOCUMENTS

| | | | |
|---|---|---|---|
| 922,205 | 5/1909 | Still | 417/61 |
| 1,703,361 | 2/1929 | Pohl | 417/477 X |
| 2,920,815 | 1/1960 | Schuarte | 417/475 |
| 3,440,966 | 4/1969 | Lagonegre | 417/477 |

FOREIGN PATENT DOCUMENTS

| | | | |
|---|---|---|---|
| 568741 | 10/1977 | U.S.S.R. | 417/475 |

*Primary Examiner*—Richard E. Gluck

*Attorney, Agent, or Firm*—Fetherstonhaugh & Co.

[57] ABSTRACT

A peristaltic pump having a housing which is formed with an annular recess which has an arcuate cross-sectional configuration, is provided with a conduit extending within the recess. The conduit has a back wall shaped to conform to the cross-sectional configuration of the recess and a flexible front wall extending transversely between opposite side edges of the back wall. Slide flanges are provided at each side edge of the front and side walls and are secured with respect to the housing to secure the conduit with respect to the housing and to hold the flanges taut. A pumping member is provided which has a rotor mounted for rotation and a plurality of rollers mounted on the rotor. The rollers each have a profile adapted to mate with the arcuate cross-sectional configuration of the recess and the pumping member is mounted with the rollers extending into the recess to an extent sufficient to compress the conduits to form transversely extending nips in each conduit. A drive motor is provided for rotatably driving the rotor.

1 Claim, 4 Drawing Figures

PERISTALTIC PUMP

FIELD OF INVENTION

This invention relates to a peristaltic pump.

PRIOR ART

In a conventional peristaltic pump, fluid is pumped through a flexible conduit by driving a compression roller along the conduit. The conventional conduit is of a circular cross-section, with the result that in order to form a nip in the conduit, it is necessary to flatten the cross-section. Considerable difficulty has been experienced in closing the nip at opposite side edges of a flattened conduit. Efforts which have been made to close the nip at the side edges of the circular conduit have increased the likelihood of rupture of the conduit at the side edges by the excessive loads which are applied.

The present invention overcomes these difficulties by providing a conduit in which the first wall is of an arcuate cross-sectional configuration and the second wall is flexible and arranged to be deflected to the configuration of the first side wall by means of a roller which is shaped to mate with the cross-sectional configuration of the first side wall.

A further advantage to be derived from a peristaltic pump constructed in accordance with the preferred embodiment of the present invention is that two conduits may be arranged to extend over circumferentially spaced arcs of curvature, both of which may be operated simultaneously to provide increased pumping capacity.

A further advantage to the structure of the preferred embodiment is that the sealing pressure applied to the conduit can be increased or decreased merely by moving the pumping member axially toward or away from the main housing which supports the pumping conduit. This is achieved by reason of the fact that the flexible walls of the conduits are disposed in a plane perpendicular to the axis of rotation of the pumping member.

SUMMARY OF INVENTION

According to one aspect of the present invention, the peristaltic pump comprises a housing, at least one conduit and a pumping member. The housing is formed with an annular recess which has an arcuate cross-sectional configuration and first and second passages opening through the housing from the recess to the back end of the housing at circumferentially spaced intervals. The conduit has a back wall shaped to conform to the cross-sectional configuration of the recess and a flexible front wall extending transversely between opposite side edges of the back wall. The conduit has side flanges which are secured to the housing, thereby to hold the front wall taut. The pumping member comprises a rotor mounted for rotation and a plurality of rollers mounted on the rotor at circumferentially spaced intervals. Each roller has a profile adapted to mate with the arcuate cross-sectional configuration of the recess and the pumping member is mounted with the rollers extending into the recess to an extent sufficient to compress the conduit to form transversely extending nips in each conduit. A drive motor is provided for driving the rotor.

PREFERRED EMBODIMENT

The invention will be more clearly understood after reference to the following detailed specification read in conjunction with the drawings, wherein FIG. 1 is a pictorial view of a peristaltic pump constructed in accordance with an embodiment of the present invention;

Figure 4:
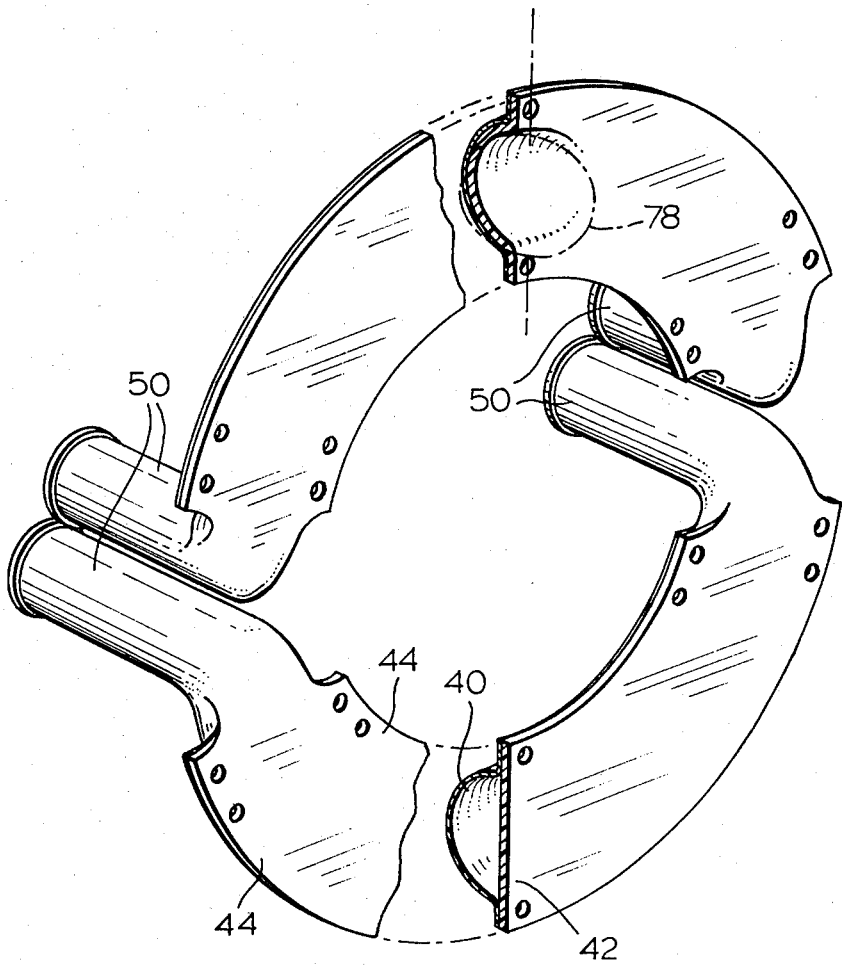
FIG. 4 is a pictorial view of a conduit suitable for use in the pump of FIG. 1.

With reference to the drawings, the reference numeral 10 refers generally to a peristaltic pump which comprises a base 12, a housing 14, a pedestal 16 and a pumping member 18. The housing 14 is rigidly mounted on the base 12 by several mounting means such as mounting bolts (not shown) with the front end 20 facing inwardly and the back end 22 facing outwardly. An annular recess 24 (FIG. 2) is formed in the front end of the housing and extends through 360° about a first axis 26. The recess 24 has an inner face 28 which has a semicircular cross-sectional configuration and a pair of oppositely disposed side edges 30. Passages 32 and 34 open from the recess 24 through the back end of the housing at 180° intervals. First and second conduits 36 and 38 are mounted in the annular recess 24. The input end of the conduit 36 and the output end of the conduit 38 open through the passage 34 to the rear of the housing and the output end of the conduit 36 and the input end of the conduit 38 open through the passage 32 to the rear of the housing. As shown in FIG. 4, the conduits 36 and 38 each have a first wall 40 and a second flexible wall 42 sealed along flanges 44. The flanges 44 are clamped to the housing 22 by means of clamping rings 46 and mounting bolts 48. The wall 40 of each conduit is supported in an arcuate configuration by the inner face 28 of the recess 24. The flexible wall 42 is normally held taut in a position bridging the side edges 30 of the recess 24. At opposite ends of each conduit the flange portions terminate and the outer wall 42 and the inner wall 40 blend into tubular end portions 50. The conduits 36 and 38 are preferably made from a flexible plastic material such as natural or synthetic rubber or NEOPRENE or VITON (Trade Marks owned by DuPont Inc.) or the like.

The pedestal 16 is rigidly mounted on the base 12 in any suitable manner and may, in fact, be formed as an integral part of the base 12. A slipway 52 is formed in the upper face of the pedestal 16.

Figure 1:
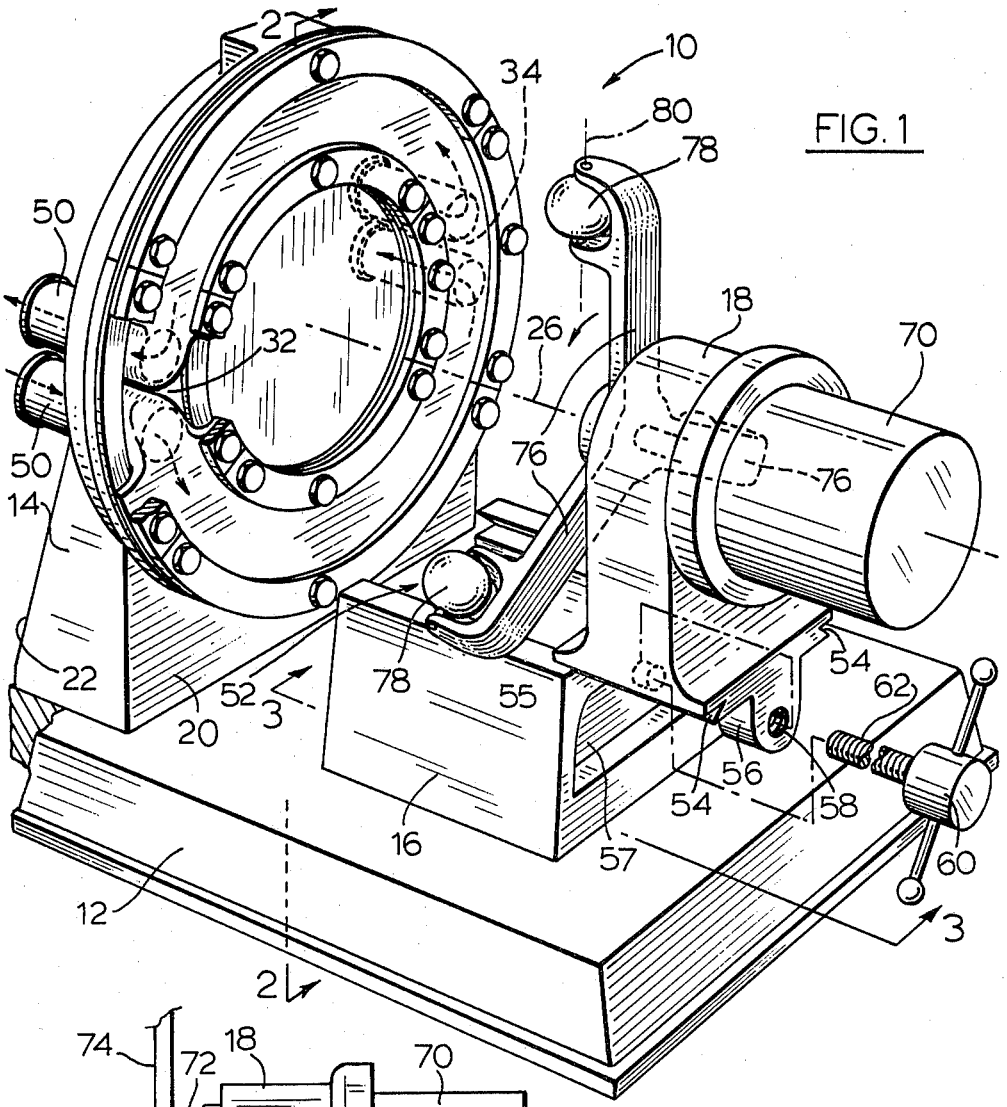
Figure 3:
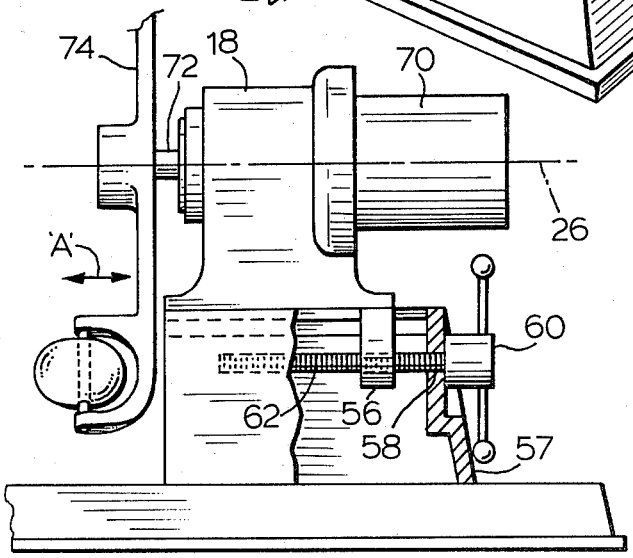
FIG. 3 is a sectional view of the pump of FIG. 1 taken along the line 3—3 of FIG. 1.

V-shaped shoulders 54 are formed on the underside of the pumping member 18 for engagement with the slipway 52 to permit longitudinal movement of the pump member 18 with respect to the pedestal 16. A lug 56 projects downwardly from the underside of the pumping member 18 and has a threaded passage 58 formed therein. An adjustment handle 60 has a threaded shank 62 which projects forwardly therefrom through the threaded passage 58 of the lug 56. By rotating the adjustment handle 60, the pumping member 18 may be moved longitudinally with respect to the pedestal 16 in the direction of the arrow A (FIG. 3).

An electric motor 70 is mounted on the pump member 18 and has an output drive shaft 72, the axis of which is aligned with the first axis 26. A rotor 74 is mounted on the shaft 72 and has three arms 76 projecting radially outwardly therefrom. A roller 78 is mounted at the outer end of each arm 76 for rotation about second axis 80 which project radially from the first axis 26. Each roller 78 has a profile adapted to mate with the profile of the recess 24 and is spaced radially outwardly from the axis 26 so that it is aligned with the recess 24.

In use, the adjustment handle 26 is employed to move the rollers 78 to a position compressing underlying portions of the conduit to close the conduit at a nip portion formed between the rollers and the rigid wall of the housing. By rotatably driving the rotor, the rollers 78 are caused to move in the direction from the input end toward the output end of each conduit in series, thereby expelling fluid material located in advance of the nip and inducing fluid material into the conduit behind the nip.

Figure 2:
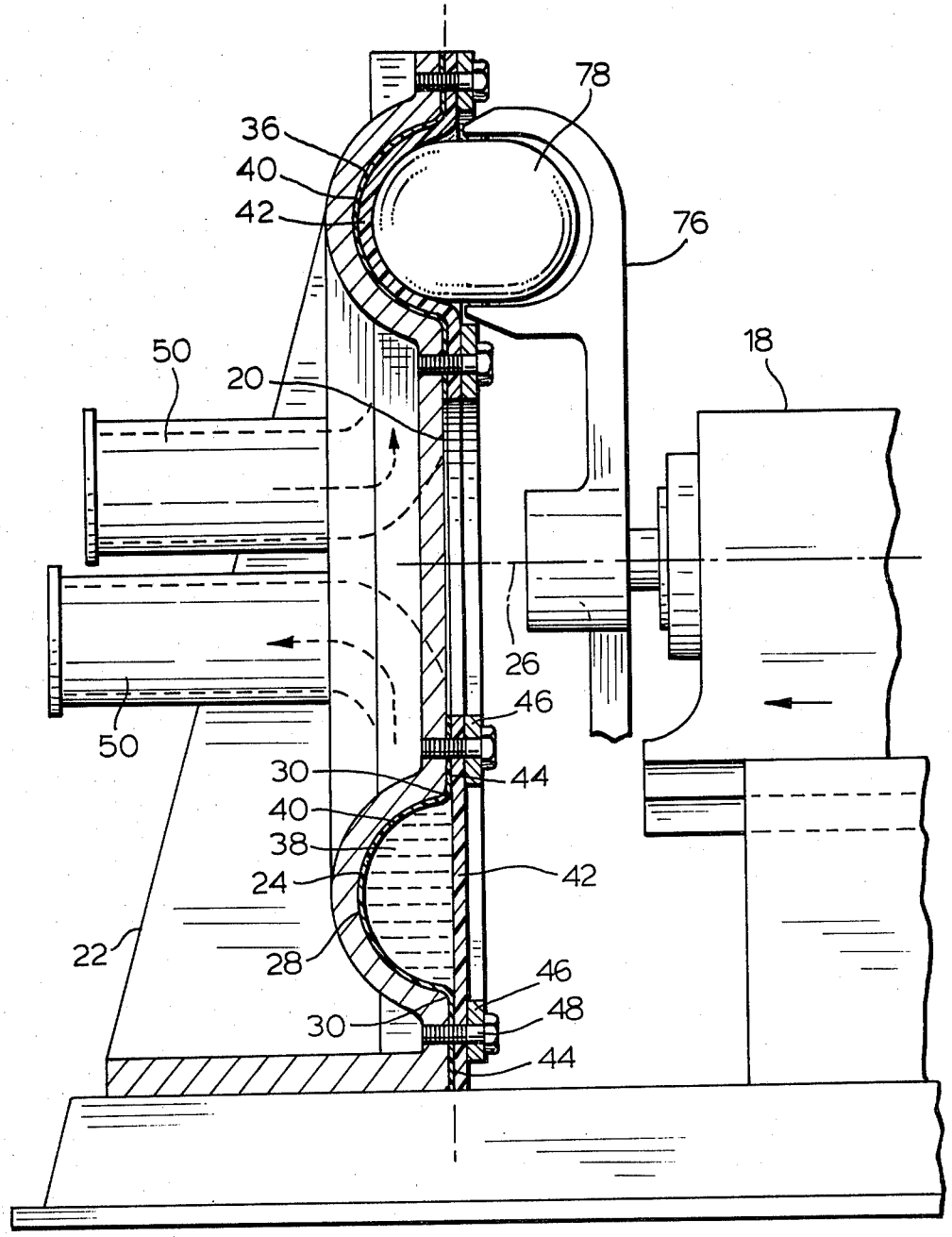
FIG. 2 is a sectional view of the pump of FIG. 1 taken along the line 2—2 of FIG. 1.

It will be noted with reference to FIG. 2 of the drawings that the flexible wall 42 can be extended into intimate engagement with the rigidly supported inner wall 40 of the conduit without difficulty being experienced in closing the side edges of the conduit because the conduit is not folded upon itself along the side edges.

It will be noted that in forming the nip, the side wall 42 will be stretched as shown in the upper half of FIG. 2 of the drawings. Thus, the pumping chamber is closed at the nip by stretching the side wall 42 rather than by attempting to compress a solid circular conduit. Thus, the difficulties previously experienced in attempting to obtain an effective seal at the side edges of a folded conduit have been overcome and the flexible material from which the side wall is formed have been made to operate to achieve the seal in the most efficient manner possible, namely, by stretching of the flexible wall.

Various modifications of the present invention will be apparent to those skilled in the art without departing from the scope of the invention. It may, for example, be possible to dispense with an inner wall along a major portion of the arcuate length of the conduit merely by permitting the inner face of the recess to act as the inner wall. In addition, the conduits may be made from a single piece of plastic material moulded to the require configuration, in which case the inner and outer walls could be integrally formed.

In a further embodiment, the channel may be formed as an annular recess opening inwardly toward the first axis 26 with the flexible wall being arranged parallel to the first axis 26; that is to say, the recess may be displaced through 90° from the position shown in FIG. 2 and the rollers may be mounted for rotation about axes extending parallel to the first axis 26 so that the face of the rollers which engages the conduit is radially outwardly directed to mate with the recess. The structure described in the preferred embodiment is believed to be superior to this alternative to the extent that it permits for the simple adjustment of the pumping rollers relative to the housing merely by axial movement of the rotor toward the housing.

In yet another embodiment, the number of rollers covered by the pumping member may be reduced to two or may be increased to more than three.

Various other modifications of the present invention will be apparent to those skilled in the art.

What I claim as my invention is:

1. A peristaltic pump comprising, (a) a housing having a front end and a back end, an annular recess formed in the front end of the housing and extending circumferentially about a first axis, said annular recess having a uniform arcuate cross-sectional configuration along its length and a pair of radially spaced side edges at the front end of the housing, first and second passages opening through the housing from the recess to the back end of the housing at circumferentially spaced intervals about the housing, (b) first and second conduits each having; a back wall shaped to conform to the cross-sectional configuration of the recess and a flexible front wall extending transversely across the back wall, an input end and an output end, said conduits being mounted in said annular recess at circumferentially spaced intervals with the input end and output end of the first conduit extending through said first and second passages respectively, and the input end and output end of the second conduit extending through said second and first passages, respectively, the back wall of each conduit being supported within the recess and the flexible front wall of each conduit extending in a first plane which is perpendicular to the first axis, said conduits each having side flanges which are secured to said housing holding said front wall taut (c) a pumping member comprising;

(i) a rotor mounted for rotation about said first axis, (ii) three rollers mounted on said rotor at uniformly spaced circumferential intervals about said first axis each for rotation about a radially directed axis, each roller having a profile adapted to mate with the arcuate cross-sectional configuration of the recess, said pumping member being mounted with said rollers extending into the recess to an extent sufficient to stretch the front wall of the conduits into engagement with the back wall thereby to form transversely extending occlusions in each conduit, (d) drive means engaging said rotor to rotatably drive it about said first axis to cause successively formed occlusions to move along each conduit from the input end to the output end to effect pumping in use.

* * * * *